United States Patent [19]

Bednarz

[11] 4,367,122

[45] Jan. 4, 1983

[54] METHOD FOR ANODIZING ALUMINUM

[76] Inventor: Joseph F. Bednarz, 287 Euclid Ave., Hackensack, N.J. 07601

[21] Appl. No.: 280,899

[22] Filed: Jul. 6, 1981

[51] Int. Cl.[3] ..... C25D 11/04; C25D 11/08; C25D 11/16

[52] U.S. Cl. ..... 204/15; 204/28; 204/33

[58] Field of Search ..... 204/15, 33, 224 R, 129.46, 204/28

[56] References Cited

U.S. PATENT DOCUMENTS 2,540,602 2/1951 Thomas ..... 204/15
3,834,998 9/1974 Watanabe ..... 204/33
3,935,080 1/1976 Gumbinner ..... 204/129.75

*Primary Examiner*—T. Tufariello
*Attorney, Agent, or Firm*—Watts, Hoffmann, Fisher & Heinke, Co.

[57] ABSTRACT

Method of anodizing an aluminum workpiece wherein the workpiece and belt of cloth fabric is moved through a contact zone over an electrically conductive rigid backing member. The relative speeds of the workpiece and the belt are adjusted so that the belt is caused to wipe across the surface of the workpiece. Anodizing solution is applied to the workpiece in the contact zone and a direct electric potential is applied with the backing member as the cathode and the workpiece as the anode.

7 Claims, 3 Drawing Figures

METHOD FOR ANODIZING ALUMINUM

TECHNICAL FIELD

This invention relates to a method for treating aluminum, and more particularly to a method of electrolytically anodizing aluminum.

BACKGROUND ART

Anodizing aluminum articles is well known. In this process, a protective oxide coating is formed at the surface of an aluminum article by electrolytic and/or chemical action. In the electrochemical process, aluminum articles are given a thin aluminum oxide coating by making the article anodic in an anodizing electrolyte such as sulfuric acid. Although the current applied to the anodizing cell may be AC or DC, usually a current having a DC component is applied such that the aluminum article is the anode.

Most prior art anodizing processes involve immersion of the workpiece in an electrolyte. These processes are time consuming and expensive to operate. When, for example, extrusions are anodized, complex electroconducting racks must be used to support the workpiece which is immersed in the anodizing bath. Heavy hoists and the like are required to manipulate these racks into and out of the bath. Immersion processes generally involve use of large tanks or vats containing anodizing solution. The use of these tanks requires venting of fumes emited from the extensive liquid surface areas. Disposal of the solution also creates economic and environmental problems.

In continuous prior art processes the strip is conveyed through vats or tanks of solution. These apparatus are complicated and energy intensive in addition to being relatively slow. For certain applications, where a high quality uniform, anodic film is required, as in lithographic plate, conventional tank type anodizing methods have proven less than desirable.

Prior art immersion type anodizing processes wherein the article is submerged in the anodic bath are somewhat difficult to control. As the oxide coating is generated, the resistivity of the cell increases changing the current density. Unless cell parameters are carefully monitored, uneven and non-uniform coatings are produced.

For lithographic applications, there is a requirement of a very uniform even anodized surface. Since anodized plate has a very smooth surface it must be treated by "graining" the surface. "Graining" creates a finish on the surface which substantially increases the surface area. Since the anodic coating is generated from the metal/oxide interface, the lithographic plate can be grained prior to anodizing.

DISCLOSURE OF INVENTION

It has been discovered that an aluminum article which may be an extrusion, a strip, tubing and the like can be anodized by bringing the aluminum article and a cloth fabric into rubbing contact in the presence of an anodizing solution, and applying an electrical potential having a DC component such that the article is the anode. The control problems of immersion cell processes are greatly reduced. Since the anodizing solution is rubbed or wiped onto the article by means of a cloth fabric, racking and immersion are eliminated. Additionally, the attendent problems surrounding use of tanks or vats of solution including disposal and fumes are likewise eliminated. The time required to provide a color anodized article is also reduced.

In accordance with the invention, tubing and other shaped workpieces are treated by holding either the cloth or the article to be anodized in a relatively stationary position. In anodizing continuous strip stock, the cloth fabric preferably forms an endless loop belt which is continuously passed between the outer periphery of a rigid lead coated backing surface and the aluminum strip surface. The strip and/or the belt are moved at different relative speeds to accomplish the critical rubbing contact between the cloth fabric and the strip surface. The process parameters can be closely controlled and the process times reduced while the quality of the coating is enhanced. In the case of lithographic plate stock, a very even and uniform anodic coating is achieved, in a relatively short process time.

In accordance with one aspect of the invention, the anodizing solution can be applied directly to the cloth fabric. In order to assure a clean reaction surface after contacting the article, the cloth fabric can be cleaned by application of a cleansing solution applied directly to the cloth. Fresh anodizing solution is then applied to the cloth fabric prior to the cloth fabric again contacting the article. Although the anodizing solution can be applied to the cloth by dipping or immersion, the preferred method of applying the anodizing solution is by spraying. Black colors can be attained after three to five minutes of anodizing by the method of this invention followed by accepted drying practice.

BEST MODE FOR CARRYING OUT THE INVENTION

Figure 1:
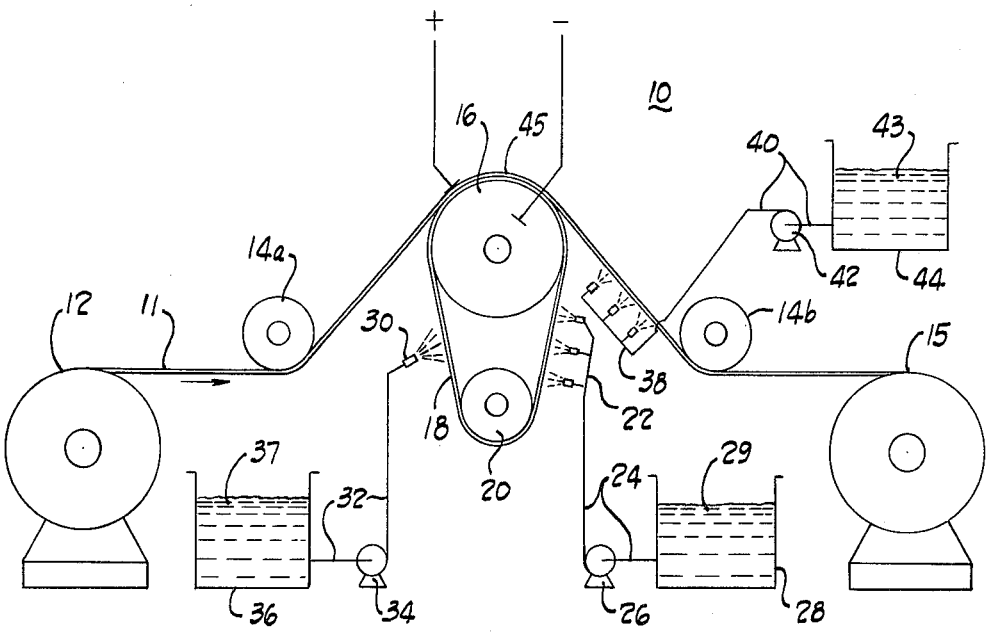
FIG. 1 is a schematic drawing of an apparatus for carrying out the anodizing process of the instant invention in a continuous manner.

Referring now to the drawings, and FIG. 1 in particular, reference numeral 10 designates an apparatus for anodizing aluminum strip 11 in a continuous process. Apparatus 10 has a feed reel 12, a backing drum 16, a pair of guide rollers 14*a*, 14*b* and a take up reel 15. The strip 11 is continuously fed from the reel 12 over the drum 16 which is disposed between the rollers 14*a*, 14*b* to the take up reel 15. A belt 18 forms an endless loop around the drum 16 and a drive roller 20. The belt 18 which is of a flexible material such as an absorbent cloth fabric or the like, is driven by the roller 20 and passes between the lower surface of the strip 11 and the outer surface of the drum 16 to form a contact zone 45.

An anodizing solution nozzle 30 is situated adjacent the belt 18 to apply an anodizing solution 37, such as an aqueous sulfuric or oxalic acid solution or a mixture of the two, to the belt 18 prior to its entering the contact zone 45. The nozzle 30 is connected by a conduit 32 and a pump 34 to a reservoir 36 that contains the anodizing solution 37.

Cleansing solution nozzles 22 are situated adjacent the belt 18 to apply a cleansing solution 29, such as water or the like to the belt 18 as the belt exits the contact zone 45. The nozzles 22 are connected by a conduit 24 and a pump 26 to a reservoir 28 that contains the cleansing solution 29.

The treated surface of the strip is washed downstream of the contact zone 45. Metal cleansing solution nozzles 38 are disposed adjacent the treated underside of the strip 11 to apply a metal cleansing solution 43. The nozzles 38 are connected by a conduit 40 and a pump 42 to a reservoir 44 that contains the metal cleansing solution 43.

Figure 2:
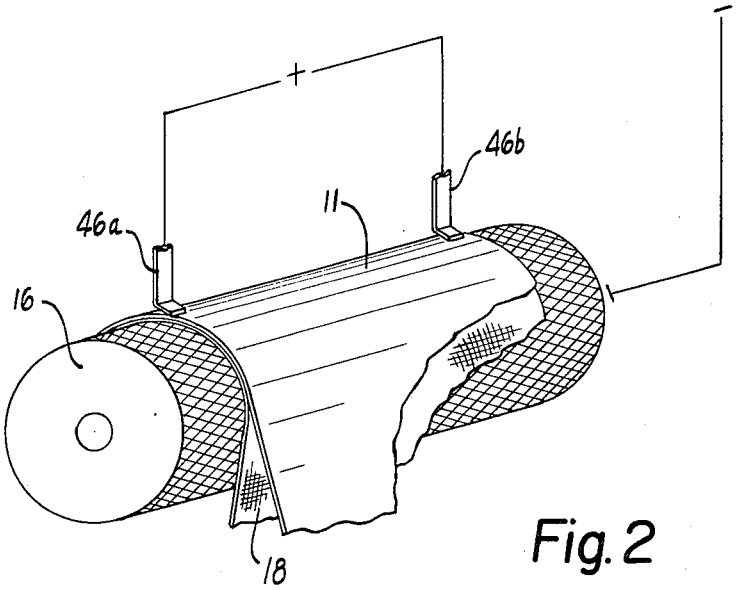
FIG. 2 is an illustration of the perforated backing drum embodied in the apparatus of FIG. 1.

A DC power source (not shown) provides an electrical potential between the drum 16 as the cathode and the aluminum strip 11 as the anode. As shown in FIG. 2, the drum 16 is attached to the negative terminal of the power source while contacts 46*a* and 46*b* are connected to the positive terminal of the power source and brought into contact with the non-reacted or back side of the aluminum strip 11 to render it anodic.

The lead coated drum 16, which may be driven in unison with the roller 20, acts as a backing surface when the belt 18 is brought into contact with the strip 11 in the contact zone 45. Rubbing, as that term is used herein, means a frictional engaging or contact with no substantial removal of material from the metal surfaces. In the illustrated form of the invention the drum 16 is made of a conducting material such as stainless steel or the like which is lead covered. In one embodiment the drum is perforated to allow excess anodizing solution 37 and reaction products to drain from the contact zone 45. In alternative constructions, the belt 18 may be backed by an expanded lead coated metal drum, a metal belt, a fixed perforated bed or the like. When employing a fixed perforated bed, the backing surface remains stationary while the belt 18 is caused to move over the fixed surface.

Fresh anodizing solution 37 applied by nozzles 30 is continuously carried by the belt 18 to the contact zone 45. The belt 18 and the roller 20 are driven so that the belt has a surface speed which is either greater or less than that of the strip 11 to provide the desired rubbing contact throughout the contact zone 45. The belt 18 is sufficiently absorbent to carry the anodizing solution to the contact zone 45. It can be of natural fibers such as wool and the like as well as synthetic materials such as fiberglass polyesters or polyacrylics. It will be realized that any absorbent web material which will withstand the reaction conditions can be utilized.

The anodizing solution 37 can be of any aqueous solution which contains disassociated ions. Advantageously the anodizing solution is acidic and more preferably a dilute solution of an acid such as sulfuric or oxalic or mixture thereof. When solutions of sulfuric acid are used, concentrations of from about 18%to about 25% by weight have been found acceptable with about 15% being preferred. The anodizing solution 37 is applied at about ambient temperature, for example temperatures in the range of about 68° F. to about 72° F.

In carrying out the invention the electric potential applied to the drum 16 and the strip 11 ranges from about 15 to about 20 volts DC with 18 volts DC being preferred. It will be realized that asymetrical "D.C. or DC superimposed AC" currents may be used. The actual voltage will depend upon variables such as the concentration of the anodizing solution, the composition of the aluminum strip, the temperature of the anodizing solution, the thickness and composition of the cloth fabric, the relatively speeds of the belt and aluminum strip, etc.

The strip 11 is in contact with the anodizing solution laden belt 18 from about 5 seconds up to about several minutes depending on the current and the variables mentioned above. The typical contact time is in the range of about 30 seconds. If desired the contact time can be interrupted or the strip 11 can be run over a series of belts 18 in order to increase production speeds.

As the belt 18 exits the contact zone 45 it contains unused anodizing solution and reaction products. The belt 18 is cleaned by application of the cleansing solution 29 applied to the belt 18 through the nozzles 22. As the belt 18 continues around the drive roller 20, but prior to again entering the contact zone 45, fresh anodizing solution 37 is applied to the belt 18 through the nozzle 30. As a result of the anodizing solution being continuously renewed and reaction products being continuously removed, the cell parameters remain substantially constant and the quality control is excellent.

The reacted surface of the strip 11 is cleaned as it exits contact zone 45 by spraying the metal cleansing solution 43 onto the strip surface through the nozzles 38. The cleansing solution may be water, but is preferably of neutralizing nature to remove the reaction product and halt the anodizing reaction so that a uniform quality product is obtained.

When lithographic plate stock is to be anodized in accordance with the continuous method of the instant invention the strip 11 is advantageously grained prior to being anodized. Since the anodic film is grown from the metal surface outward, a finely grained surface produced prior to anodizing is not deleteriously affected by the anodizing process of the instant invention.

Graining of metal lithographic plates is generally accomplished by mechanical and/or chemical methods. In accordance with one mechanical method generally used, called ball graining, a plurality of steel balls are laid on the bed of a steel ball graining machine in contact with the surface of the plate to be grained. Sand or pumice and water are added to form a slurry and the balls are rotated over the plate surface. The slurry is thus caused to abrade the plate surface under the pressure and movement of the rotating balls. Another type of mechanical graining is referred to as brush graining. In accordance with this method brushes are substituted for the steel balls employed in the ball graining process. The brushes are caused to rotate and oscillate over the surface of the aluminum plate which contains sand or other abrative materials to grain the surface. Chemical methods include use of corrosive chemicals such as aqueous solution and mixtures of acidic or caustic material which are brought into contact with the surface for a specific time to cause selective pitting.

Figure 3:
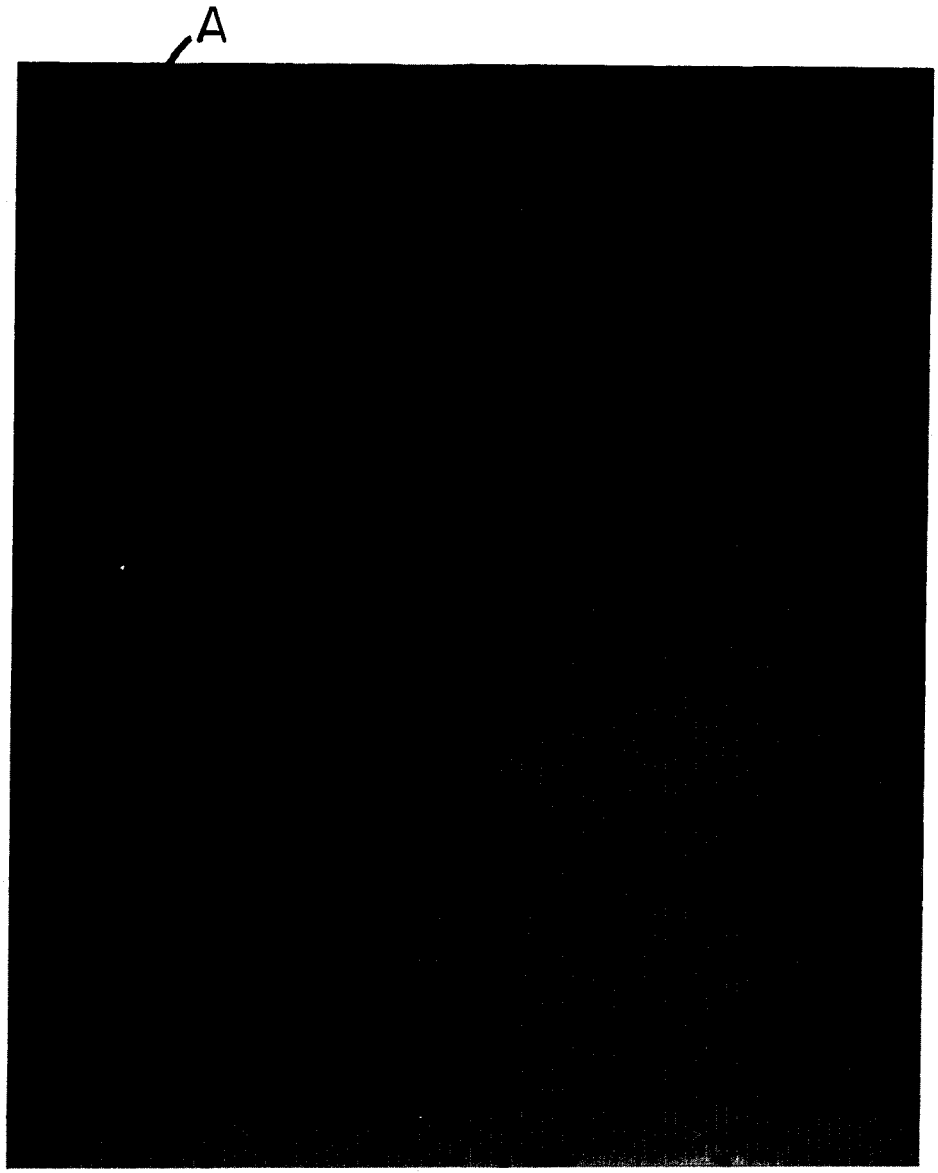
FIG. 3 is a micrograph of a sample of an anodized aluminum article prepared in accordance with the invention.

A sample of a grained aluminum strip anodized in accordance with the invention is shown in FIG. 3. This figure is a micrograph taken by Transmission Electron Microscopy (TEM) at 25,000 X. The sample, taken from the edge of the article, is coated with a 60% Au-40% Pd alloy and embedded in an epoxy media for handling purposes. TEM photographs were taken of this section to characterize the surface areas of interest. In FIG. 3, reference character A is the aluminum substrate, reference character B a part of the alloy coating, reference character C the embedding media, and reference character D a polymeric film. Reference character E indicates the anodic coating formed by the method of the invention.

The result of performing the anodizing process on a grained plate is a formation of a grained, commercial grade, anodically coated, lithographic plate material.

The following examples are given by way of illustration of the nature of the instant invention but are not intended to be limitations on the scope thereof.

EXAMPLE I

In this example, No. 1100 (99% aluminum) plate stock strip was successfully anodized in accordance with the instant invention utilizing the apparatus similar to that described in connection with FIG. 1. The belt 18 was of a wool fabric. The anodizing solution, an aqueous solution of 20% $H_2SO_4$ by weight, was maintained at a temperature of 70° F. within the reservoir 36. A DC voltage of 20 volts was applied between the drum 16 and the strip 11. The strip 11 and the cloth belt 18 were then put in motion.

After the aluminum strip had been in contact with the anodizing solution-soaked cloth for about 120 seconds, the resulting plate was evaluated. A commercial grade anodized coating had been produced.

EXAMPLE II

In this example, the apparatus was substantially identical to that of Example I. As can be seen in Table I, the concentration of the aqueous anodizing solution was reduced to 15% $H_2SO_4$ by weight. The aluminum strip 11 was continuously contacted with the wool belt 18 for 120 seconds. The plate produced was of good commercial grade.

TABLE 1

| | |
|---|---|
| Aluminum Stock | 1100 |
| Anodizing Solution | 15% $H_2SO_4$ by weight |
| Cathode: | lead lined drum |
| Cloth: | wool |
| Temperature: | |
| Metal | ambient |
| Anodizing Solution | 70° F. at start |
| Contact Time: | 120 seconds |
| Voltage: | 20 volts |

EXAMPLE III

In this example, the apparatus of Example I was used. The test parameters are listed in Table 2 and were identical to those used in Example II except that the voltage was reduced to 18 volts. Again the aluminum strip was continuously contacted with the wool belt for the time indicated. The plate produced was of good commercial grade.

TABLE 2

| | |
|---|---|
| Aluminum Stock | 1100 |
| Anodizing Solution | 15% $H_2SO_4$ by weight |
| Cathode: | lead lined drum |
| Cloth: | wool |
| Temperature: | |
| Metal | ambient |
| Anodizing Solution | 70° F. at start |
| Contact Time: | 120 seconds |
| Voltage: | 18 volts |

EXAMPLE IV

In this example, the apparatus was substantially identical to that of Example I. The plate material was grained prior to being anodized. The parameters are shown in Table 3. The lithographic plate produced was of good commercial grade.

TABLE 3

| | |
|---|---|
| Aluminum Stock | (grained previous to anodizing) |
| Anodizing Solution | 20% $H_2SO_4$ |
| Temperature: | 70° F. |
| Cathode | lead on perforated metal |
| Cloth | polyester-wool mix |
| Contact Time: | 30 seconds |
| Voltage: | 15 volts |

While the invention has been explained in relation to its preferred embodiment, it is understood that various modifications thereof will become apparent to those skilled in the art upon reading the specification and it is intended to cover such modifications as fall within the scope of the appended claims.

I claim:

1. A method of anodizing an aluminum workpiece comprising the steps of:

(a) moving the workpiece and a belt of cloth fabric through a contact zone over an electrically conductive rigid backing member;

(b) adjusting the relative speeds of the workpiece and the belt so that the belt is caused to wipe across the surface of the workpiece;

(c) supplying an anodizing solution to the workpiece in the contact zone, whereby the wiping action of the belt continuously removes reaction products from the workpiece surface and exposes fresh surface area to the solution; and (d) applying a direct electric potential with the backing member as the cathode and the workpiece as the anode.

2. The product produced by the process of claim 1.

3. The method of claim 1 wherein said anodizing solution is an aqueous solution of an acid selected from sulfuric, oxalic, and mixtures thereof.

4. A method of anodizing aluminum strip comprising the steps of:

(a) moving the strip and an endless belt loop of cloth fabric through a contact zone over a perforated, electrically conductive backing member;

(b) applying an anodizing solution to the fabric belt;

(c) adjusting the relative speeds of the belt and strip so that the belt is caused to wipe continuously across the strip surface to remove reaction products and expose fresh surface area to the solution;

(d) cleaning the belt subsequent to the contact zone and reapplying fresh anodizing solution to the cleansed belt; and (e) applying a direct electric potential with the backing member as the cathode and the strip as the anode.

5. The method of claim 4 wherein the anodizing solution comprises an aqueous sulfuric acid solution of from about 10% to about 25% by weight sulfuric acid.

6. The method of claim 4 wherein the strip is a lithographic platestock which is grained prior to being anodized.

7. The product produced by the process of claim 6 or claim 4.

* * * * *